US009505987B2

(12) United States Patent
Francisco et al.

(10) Patent No.: US 9,505,987 B2
(45) Date of Patent: Nov. 29, 2016

(54) DEMETALLIZATION PROCESS FOR HEAVY OILS

(71) Applicants: Manuel A. Francisco, Phillipsburg, NJ (US); Roberto Garcia, Easton, PA (US)

(72) Inventors: Manuel A. Francisco, Phillipsburg, NJ (US); Roberto Garcia, Easton, PA (US)

(73) Assignee: EXXONMOBIL RESEARCH AND ENGINEERING COMPANY, Annandale, NJ (US)

( * ) Notice: Subject to any disclaimer, the term of this patent is extended or adjusted under 35 U.S.C. 154(b) by 0 days.

(21) Appl. No.: 14/645,977

(22) Filed: Mar. 12, 2015

(65) Prior Publication Data

US 2016/0264878 A1 Sep. 15, 2016

(51) Int. Cl.
*C10G 17/04* (2006.01)
*C10G 27/12* (2006.01)

(52) U.S. Cl.
CPC ..... *C10G 27/12* (2013.01)

(58) Field of Classification Search
CPC ..... C10G 17/04
See application file for complete search history.

(56) References Cited

U.S. PATENT DOCUMENTS 4,522,702 A * 6/1985 Kukes ..... C10G 17/04 208/211
4,601,816 A * 7/1986 Rankel ..... C10G 53/06 208/190
4,851,199 A * 7/1989 Young ..... C22B 34/22 423/321.1
5,087,350 A * 2/1992 Paris-Marcano ..... C10G 17/02 208/219
6,007,705 A 12/1999 Greaney et al.
7,153,414 B2 12/2006 deSouza

FOREIGN PATENT DOCUMENTS

WO 2007142650 A1 12/2007

OTHER PUBLICATIONS

K.A. Gould, "Oxidative demetallization of petroleum asphaltenes and residua", Fuel, 1980. vol. 59, pp. 733-736.
H. Zhang, Y. Yan, W. Sun and J. Wang, "Structural Description of Polyaromatic Nucleus in Residue", China Petroleum Processing and Petrochemical Technology, No. 3, Sep. 2007, pp. 35-42.

* cited by examiner

*Primary Examiner* — Randy Boyer
(74) *Attorney, Agent, or Firm* — Malcolm D. Keen; Chad A. Guice

(57) ABSTRACT

Heavy oils containing metalloporphyrins principally of nickel and vanadium are demetallized using an oxidizing agent such as aqueous hydrogen peroxide and catalytic amounts of phosphoric acid, preferably with tungstic acid in combination with a phase transfer agent. Up to 99% of the Ni and V are deposited in the aqueous phase and are removed from the oil. The homogenous, water soluble reactants and catalyst have the advantage of being separated more easily from the Ni and V dissolved in the aqueous phase than the same metals deposited on solid phase heterogeneous catalysts.

10 Claims, 1 Drawing Sheet

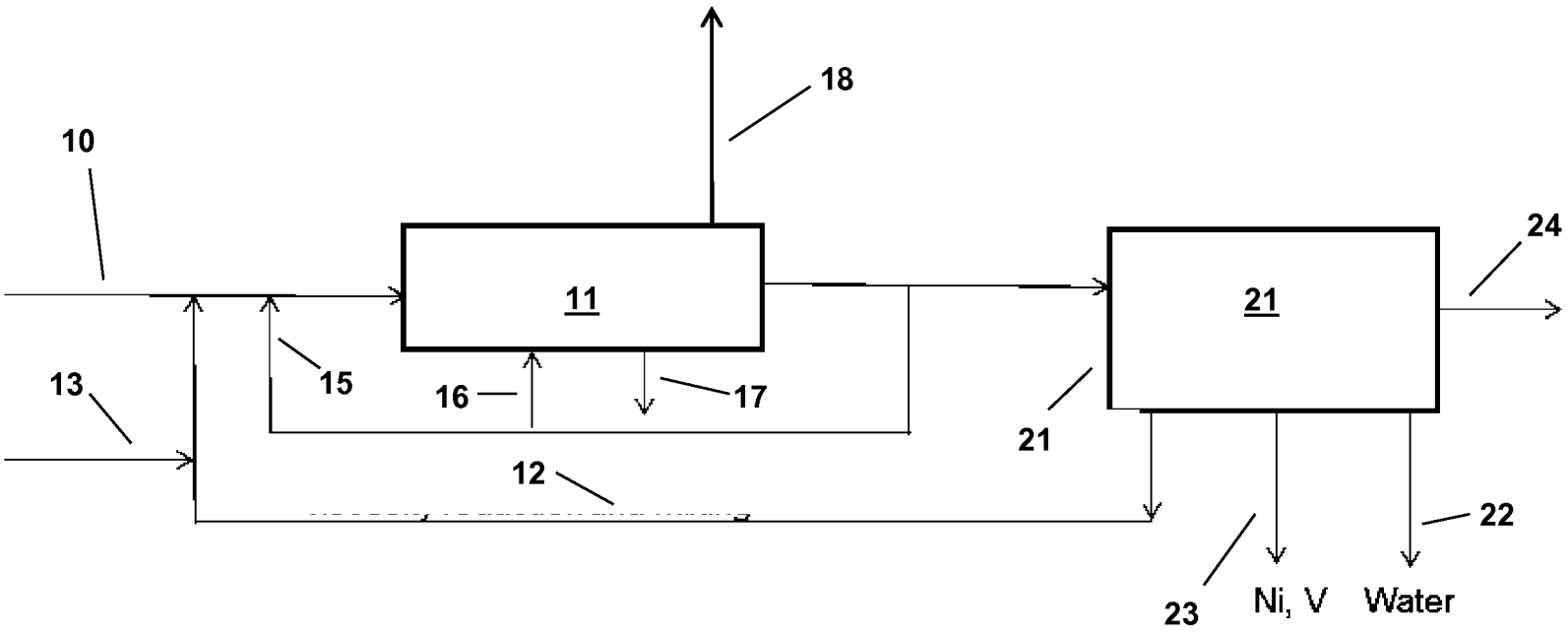
24
22
Water
21
Ni, V
23
21
18
17
11
12
16
15
10
13

DEMETALLIZATION PROCESS FOR HEAVY OILS

FIELD OF THE INVENTION

This invention is directed to the demetallization of heavy oils, resids and bitumens.

BACKGROUND OF THE INVENTION

A large portion of oil and reserves now undergoing recovery can be characterized as heavy oil or bitumen, typically containing high levels of maltene and asphaltene fractions. Because heavy oils are forming a larger proportion of production volumes, their conversion into lower boiling and more valuable fractions such as gasoline, kerosene and road diesel, is progressively forming a greater part of the petroleum refining process.

Considerable process technology already exists for upgrading heavy crudes, bitumens, and coal liquids. Among those broad categories of known heavy oil primary upgrading processes are carbon rejection process such as catalytic cracking, thermal cracking e.g. coking, demetallization processes, hydrogen addition processes such as hydrocracking and gasification or combustion processes. The presence of high levels of metal contaminants in these fractions creates problems in both catalytic and non-catalytic refining processes. Catalytic processes, whether of the hydrogen addition or carbon rejection type often require the use of large quantities of solid catalysts which are subject to reduced throughput and high catalyst replacement costs resulting from the catalyst deactivation when processing heavy oils when the contaminants can migrate onto the catalyst at high temperatures. Deactivation usually results from the deposition of contaminants onto the surfaces of the catalysts from the feed; contaminants typically include metal compounds, high molecular weight refractory compounds (or coke derived therefrom), or sulfur or nitrogen containing heterocyclic compounds. Depending on the identity of these contaminants, they may react with catalyst components under certain conditions to form low melting eutectic compositions which can either sinter molecular sieves, zeolites, or other high surface area catalyst supports components or block catalyst pores. In either case, catalyst effectiveness is significantly reduced. In addition, the presence of catalytic metals may have deleterious effects upon the process itself; in catalytic cracking, for example, high levels of nickel or vanadium in the feed may effectuate excessive gas and coke formation in the cracker. Finally, if these metals are carried through to the products, adverse consequences may result from their use, for instance, vanadium in fuel oils is apt to lead to the formation of sulfur oxides in the atmosphere and "acid rain".

In thermal carbon rejection processes, the presence of high levels of metal contaminants may lead to the generation of hard, adherent fouling deposits on the walls of equipment used in the processing, especially furnaces and heat exchangers. Asphaltenes and some resin fractions typically contain significant quantities of these contaminants and so, even though asphaltenes may comprise only 10% to 15% of some heavy oil feedstocks, they disproportionally contribute to the fouling of refinery equipment or the deactivation of solid catalysts. The predominant metallic poisons in heavy oils, resids and bitumens are nickel and vanadium metalloporphyrins which should be removed to the extent possible before these materials enter thermal or catalytic upgrading processes. Various types of demetallization processes are known in the refining industry including solvent extraction with both hydrocarbon and aqueous extractants as well as catalytic hydrogenative processes. Solvent deasphalting using light paraffinic solvents such as propane and butane are effective to a certain extent for demetallization since they remove a portion of the metalloporphyrins in the asphaltene fraction which is precipitated by the paraffin.

U.S. Pat. No. 6,007,705 (Greaney) discloses one example of an aqueous extraction process for demetallizing by contacting a metals-containing petroleum feed in the presence of an aqueous base selected from Group IA and IIA hydroxides and carbonates and ammonium hydroxide and carbonate together with an oxygen containing gas and a phase transfer agent at a temperature of up to 180° C.

Combined oxidative/extraction techniques have also been explored as described by Gould, "Oxidative demetallization of petroleum asphaltenes and residua", *Fuel*, vol. 59, pp. 773-736 (October 1980): asphaltenes and vacuum residuum were treated with oxidizing agents in aqueous solutions, including peroxyacetic acid, which exhibited high demetallization activity coupled with the ability to remove or destroy petroporphyrins.

SUMMARY OF THE INVENTION

We have found that treatment of model metalloporphyrins with aqueous $H_2O_2$, and catalytic amounts of tungstic acid ($H_2WO_4$) and phosphoric acid ($H_3PO_4$) in combination with a phase transfer agent removes up to 99% of the Ni and V which are deposited into the aqueous phase. According to the present invention, heavy oils containing metalloporphyrins principally of nickel and vanadium are demetallized using aqueous hydrogen peroxide and catalytic amounts of phosphoric acid, preferably with tungstic acid in combination with a phase transfer agent. The Ni and V are deposited into the aqueous phase and are removed from the oil. The reaction is slower if the tungstic acid is removed but it still removes 85% of the Ni and V while it is also less effective without the phase transfer agent. The homogenous, water soluble reactants and catalyst have the advantage of being separated more easily from the Ni and V dissolved in the aqueous phase than the same metals deposited on solid phase heterogeneous catalysts.

DRAWING

The single FIGURE of the drawings is a simplified schematic for carrying out the present process.

DETAILED DESCRIPTION

The present demetallization process is applicable to metals-containing petroleum streams derived from mineral oil sources including shale oil and tar sand oil and bitumens; the process is particularly useful with hydrocarbon streams associated with hydrocarbon soluble metal contaminants, e.g. petroporphyrins. The main metal contaminants which are present in these streams are nickel and vanadium and these are the metals which not only present particular problems in catalytic refining processes but also are more resistant to removal than other metals such as iron (Fe) for which other removal processes are available. Principally, the process will be employed with heavy oils which contain the majority of metal components in the petroleum, usually high boiling oils with a boiling point over about 345° C. (650° F.) and more usually with those boiling above about 540° C. (about 1000° F.) or higher, e.g. above about 600° C. (about 1110° F.). It is therefore useful with fossil fuel streams such as crude oils and bitumens, as well as processed/distilled streams (distillation residues), reduced crudes, heavy gas oils, residual fractions (atmospheric and vacuum resids) and asphaltene fractions from solvent deasphalting. Hydrocarbon soluble metal components in these petroleum streams have traditionally have been difficult to remove and have required the use of strong oxidizing agents or application of high temperatures and/or high pressures, particularly when mild oxidizing agents have been used.

The metallic components that may be treated include Ni and V species, as these are typically present in the high boiling fractions of petroleum streams. Transition metals such as Ni and V are often found in porphyrin and porphyrin-like complexes or structures, and are most abundant in the heavy petroleum fractions. In these feeds such metal species tend to be found in non-water soluble or water-immiscible structures.

The range of metals contents in feeds of this type may typically extend over a wide range. The average vanadium in the feed is typically from about 5 ppm to about 2,000 ppm, often from about 20 to about 1,000 ppm, by weight, e.g. from about 20 to about 100 ppm. The average nickel content in the starting feed is typically from about 2 to about 500 ppm, e.g. about 2 to about 250 ppm by weight or from about 2 to 100 ppm.

The metals-containing petroleum feed to be treated should preferably be in a liquid state at the selected process conditions in order to facilitate contact between the oil and the aqueous extractant; this may be accomplished by heating the oil or by the addition of a suitable solvent, e.g. a lower boiling hydrocarbon oil, as needed.

The demetallization process is carried out by contacting the selected metal-containing feed with an aqueous oxidizing agent and a catalytic amount of phosphoric acid. The removal of the metals, especially Ni and V, is promoted by the use of tungstic acid ($H_2WO_4$) and by the use of a phase transfer agent. The oxidation in the presence of phosphoric acid is capable of removing up to 85% of the nickel and vanadium and with the use of the tungstic acid as a co-catalyst, removal of up to 99% of these metals becomes possible.

The aqueous treatment solution provides an oxidizing agent which brings the metals to a higher oxidation states, facilitating the formation of water-soluble complexes with the phosphoric acid and the tungstic acid, if present. The function of the oxidizing agent is to open up aromatic rings in the feed to allow removal of the metals. The amount of aromatic carbon needing to be oxidized to convert all 4 ring and higher aromatics to 3 ring aromatics may be calculated from the number of aromatic rings that are in the feed with 3, 4 or 5 aromatics rings or higher and from this the amount of oxidizing agent needed to carry the oxidation to the required extent can be determined. This, however, is difficult to establish as it would take an extensive analysis of all the aromatic carbon in the resid. For this reason, it is simpler and more practical to use the oxidizing agent, e.g. hydrogen peroxide, in excess.

Suitable oxidizing agents include peracids (peroxyacids) especially the organic peroxycarboxylic acids such as such as peracetic acid and meta-chloroperoxybenzoic acid although inorganic peroxy acids such as meta-chloroperoxybenzoic acid (mCPBA), peroxymonosulfuric acid (Caro's acid) are not excluded. The oxidation function may be provided in combination with the phosphoric acid component by the use of peroxyphosphoric acid ($H_3PO_5$). The preferred oxidant, however, is hydrogen peroxide, preferably at a solution strength of at least 10% v/v and advantageously, higher, e.g. at 20% v/v or 30% v/v although more concentrated solutions e.g. over 50% v/v will not be preferred for reasons of safety and availability. The hydrogen peroxide, being inexpensive, may be used in considerable excess relative to the oil.

The phosphoric acid component ($H_3PO_4$) is readily available commercially, often as is an 85% aqueous solution which can be diluted as required. Dilute aqueous solutions of phosphoric acid exist in the ortho-form (orthophosphoric acid). The phosphoric acid is present in minor, catalytic amounts relative to the oil and the hydrogen peroxide as shown below.

Tungstic acid, a hydrated form of tungsten trioxide, $WO_3$, is preferably used in combination with the phosphoric acid and has been found to materially improve the extraction of nickel and vanadium into the aqueous medium although a good degree of demetallization up to about 85% may be achieved by the use of the phosphoric acid alone in combination with the oxidant. As with the phosphoric acid, the tungstic is present in minor, catalytic amounts relative to the oil and the hydrogen peroxide.

A phase transfer agent is preferably used in the solution, to promote a decreased metals content in the treated feed. Phase-transfer agents are compounds that facilitate the migration of a reactant from one phase into another phase where reaction occurs. Ionic reactants are often soluble in an aqueous phase but insoluble in an organic phase in the absence of the phase-transfer agent so that then, the phase transfer agent functions like a detergent for solubilizing the salts into the organic phase. Effectively, one or more of the reactants are transported into a second phase which contains both reactants.

Phase-transfer agents are compounds that facilitate the migration of a reactant from one phase into another phase where reaction occurs. Ionic reactants are often soluble in an aqueous phase but insoluble in an organic phase in the absence of the phase-transfer agent so that then, the phase transfer agent functions like a detergent for solubilizing the salts into the organic phase. Effectively, one or more of the reactants are transported into a second phase which contains both reactants.

The phase transfer agent may be miscible or immiscible with the petroleum stream to be treated although for optimal functioning it should be mutually soluble in both the aqueous extractant and the hydrocarbon stream. Solubility in the hydrocarbon is typically influenced by the length of the hydrocarbon chain in the molecule of the phase transfer agent and solubility in the water by the presence of hydrophilic groups in the molecule. Examples of typical phase transfer agents include quaternary ammonium and phosphonium salts such as benzyltrimethylammonium chloride, methyltrioctylammonium chloride, tetra-n-butylammonium bromide or hexadecyltributylphosphonium bromide, crown ethers, and open-chain polyethers such as polyethylene glycols. Starks' catalyst, commerically available as Aliquat 336™, is a preferred quaternary ammonium salt useful in the present process as a phase transfer catalyst and metal extraction reagent. It contains a mixture of $C_8$ (octyl) and $C_{10}$ (decyl) chains with $C_8$ predominating. The agent may be supported or unsupported. While the concentration in the aqueous extractant may vary, concentrations typically of 0.1 to 10 wt % are used.

The FIGURE is a simplified process schematic of a unit for carrying out the demetallization process. The resid or other heavy petroleum origin feed enters by way of line 10 and passes to stirred tank reactor 11 in which the demetallization reaction is carried out with regenerated catalyst which enters line 10 from recycle line 12 supplemented as necessary by make-up catalyst solution entering through line 13. A recycle loop 15 brings a portion of the effluent from reactor 11, including demetallated feed, in order to improve mixing in the reactor and for viscosity control as the demetallated product will be less viscous than the feed. Air is supplied through line 16 in order to provide agitation and promote oxidizing conditions while cooling for the reaction may be provided by coolant circulating through a cooling loop with its inlet and outlet collectively indicated by 17. Vapor phase effluent from the reactor, mainly comprising oxidation products arising from the treatment such as $CO_2$, SOx, NOx, as well as $N_2$, $CH_4$ and other light hydrocarbon ends, is removed through line 18.

The effluent from the reactor is taken by way of line 20 to product recovery and catalyst regeneration section 21 in which the catalyst solution is regenerated and returned to the reactor through line 12 while excess water is led off through line 22. Nickel and vanadium residues are removed through line 23. Demetallized oil is taken out by way of line 24 for further processing in the refinery.

EXAMPLES

A sample of Cold Lake Vacuum Residue (CLVR) was demetallated using hydrogen peroxide as the oxidant and tungstic acid as an oxidation catalyst. Toluene was used as a solvent in all runs to reduce viscosity. Initially, the CLVR, toluene and Aliquat™ 336 were blended together to form Blend A which was then combined with the aqueous Blend B of hydrogen peroxide and phosphoric acid, finally, the oxidation catalyst (tungstic acid) was added. All reactions were carried out at 80° C. for 24 hours after which a separatory funnel was used to separate the aqueous layer. The aqueous layer was tested for $H_2O_2$ levels (~10 ppm). A Liquid-Liquid continuous extraction apparatus was used for 24 hrs to extract the Aliquat from the organic layer which was then vacuum evaporated using a Rotovap™ evaporator to constant weight. The treated oil was analyzed for nickel, vanadium and oxygen content.

Table 1 below shows three different experimental conditions and corresponding results. Run 142 is considered the base case; it uses the hydrogen peroxide in excess to ensure that oxidation of the polynuclear aromatics to those with only 3 rings is complete, allowing removal of the metals. Tungstic acid and Aliquat 336™ as the phase transfer agent were also added to the reaction mixture. Run 143 was designed to test the effect of Aliquat 336. Run 146 was designed to test the effect of the absence of catalyst Aliquat 336 and acid simultaneously. The results indicate that the combined effects of a phase transfer agent and tungstic acid reduces the metal content significantly.

TABLE 1

| Run | 142 | | 143 | | 146 | |
|---|---|---|---|---|---|---|
| Species | Grams | moles | Grams | moles | Grams | moles |
| $H_2O_2$ 30% | 163.80 | 1.45 | 163.80 | 1.45 | 163.8 | 1.45 |
| $H_2WO_4$ | 1.61 | 6.44E−03 | 1.61 | 6.44E−03 | 0 | 0 |
| Aliquat 336 | 0.48 | 1.19E−03 | 0.0 | 0 | 0 | 0 |
| $H_2PO_4$ 10% | 2.41 | 2.46E−03 | 2.41 | 2.46E−03 | 0 | 0 |
| Toluene, ml | 200 | | 200 | | 200 | |
| CLVR | 5.1 | NA | 5.1 | NA | 5.1 | NA |
| Results | Substrate | Product | Product | | Product | |
| Ni ppm | 134 | 0.74 | 20 | | 84 | |
| V ppm | 338 | 5.41 | 97 | | 246 | |
| Oxygen % | 0.94 | 9.11 | 10.2 | | 8.3 | |

The invention claimed is:

1. A process for demetallating a petroleum stream which comprises:

contacting a petroleum stream comprising metal-containing components with an aqueous oxidant solution comprising hydrogen peroxide, tungstic acid and phosphoric acid.

2. A process according to claim 1 in which the petroleum stream comprises a stream boiling above 540° C.

3. A process according to claim 1 in which the petroleum stream comprises a vacuum resid.

4. A process according to claim 1 in which the petroleum stream comprises asphaltenes containing metalloporphyrins of nickel and/or vanadium.

5. A process according to claim 1 wherein the aqueous oxidant solution further comprises a phase transfer agent.

6. A process according to claim 5 in e phase transfer agent comprises a quaternary ammonium salt.

7. A process according to claim 6 in which the quaternary ammonium salt as alkyl substituents on the nitrogen comprising a mixture of $C_8$ and $C_{10}$ chains wherein a predominant amount of the mixture are $C_8$ chains.

8. A process according to claim 1 in which the petroleum stream is dissolved in a solvent.

9. A process according to claim 1 in which the petroleum stream comprises aromatics with at least 4 rings.

10. A process according to claim 1 in which the amount of the aqueous oxidant solution is at least sufficient to substantially affect ring opening of the aromatics with at least 4 rings to produce aromatics with 3 rings.

* * * * *